United States Patent [19]

Evers

[11] Patent Number: 5,060,339

[45] Date of Patent: Oct. 29, 1991

[54] BLOWER ATTACHMENT FOR A VACUUM CLEANER

[76] Inventor: Robert S. Evers, 1405 West First St., Pella, Iowa 50219

[21] Appl. No.: 583,125

[22] Filed: Sep. 17, 1990

[51] Int. Cl.[5] ..... A47L 5/14; A47L 9/08

[52] U.S. Cl. ..... 15/246; 15/330; 15/337; 15/344; 15/405; 15/415.1

[58] Field of Search ..... 15/330, 328, 331, 332, 15/333, 334, 335, 336, 337, 338, 339, 344, 405, 408, 412, 414, 415.1, 246, 330, 337, 344, 415.1; D28/18; 132/271

[56] References Cited

U.S. PATENT DOCUMENTS

| | | | |
|---|---|---|---|
| 1,902,621 | 8/1933 | Allen | 15/338 |
| 2,753,434 | 7/1956 | Storm, Jr. | 15/330 |
| 2,788,541 | 4/1957 | Kemnitz | 15/330 |
| 2,788,541 | 4/1957 | Kemnitz | 15/330 |
| 2,788,936 | 4/1957 | Kemnitz | 230/47 |
| 2,827,060 | 3/1958 | Marty | 15/405 |
| 2,902,708 | 9/1959 | Riley | 15/330 |
| 2,920,337 | 1/1960 | Smith | 15/323 |
| 3,407,430 | 10/1968 | Renner | 15/414 |
| 3,890,985 | 6/1975 | Hicks | 132/271 |
| 3,933,177 | 1/1976 | Dwyer, Jr. | 137/608 |
| 4,114,230 | 9/1978 | MacFarland | 15/330 |
| 4,187,577 | 2/1980 | Hansen | 15/328 |
| 4,225,999 | 10/1980 | Martinec et al. | 15/300 A |
| 4,955,145 | 9/1990 | Scivoletto | 132/271 |

*Primary Examiner*—Harvey C. Hornsby
*Assistant Examiner*—Tony Soohoo
*Attorney, Agent, or Firm*—Henderson & Sturm

[57] ABSTRACT

A blower attachment for a vacuum cleaner including an attached member disposed over the exhaust air discharge openings that extend around the vacuum cleaner casing. The attached member includes a strap section that extends over and blocks air flow from some of the discharge openings, and a plenum section that extends over and receives the flow of air from the remaining unblocked discharge openings. The plenum section tapers from the inlet port to an air output orifice that may be connected by conventional methods to inflate any of a number of devices that require a high volume of low pressure air. Tabs extending inward from the attached member are received in corresponding discharge openings to secure the attached member to the casing in an aligned position over the discharge openings.

7 Claims, 2 Drawing Sheets

BLOWER ATTACHMENT FOR A VACUUM CLEANER

TECHNICAL FIELD

This invention relates to vacuum cleaners, and more particularly to a vacuum cleaner blower attachment.

BACKGROUND ART

Vacuum cleaners are well known household appliances and the art related to vacuum cleaners is highly developed. One application of the vacuum cleaner is as a power source to inflate expandable goods, such as air mattresses, rafts, and other inflatable toys and devices that require a high volume of low pressure air.

Although several blower attachments are known, most are complicated structures designed for use with conventional canister or upright vacuum cleaners. Since conventional vacuum cleaners are not designed to be used outside of the household environment, the use of known attachments is likewise confined to the household environment while many of the inflatable products are designed for outdoor use. Although portable, hand held, battery-operated vacuum cleaners have been available for some time, no suitable blower attachments have been made available.

Those concerned with these and other problems recognize the need for an improved blower attachment for a vacuum cleaner.

DISCLOSURE OF THE INVENTION

The present invention provides a blower attachment for a vacuum cleaner including an attached member disposed over the exhaust air discharge openings that extend around the vacuum cleaner casing. The attached member includes a strap section that extends over and blocks air flow from some of the discharge openings, and a plenum section that extends over and receives the flow of air from the remaining unblocked discharge openings. The plenum section tapers from the inlet port to an air output orifice that may be connected by conventional methods to inflate any of a number of devices that require a high volume of low pressure air. Tabs extending inward from the attached member are received in corresponding discharge openings to secure the attached member to the casing in an aligned position over the discharge openings.

An object of the present invention is the provision of an improved blower attachment for a vacuum cleaner.

Another object is to provide a blower attachment suitable for use with hand-held, portable vacuum cleaners.

A further object of the invention is the provision of a blower attachment for a vacuum cleaner that is convenient and easy to use.

Still another object is to provide a blower attachment that is uncomplicated in structure and inexpensive to manufacture A still further object of the present invention is the provision of a blower attachment for a vacuum cleaner that is durable and easy to maintain.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
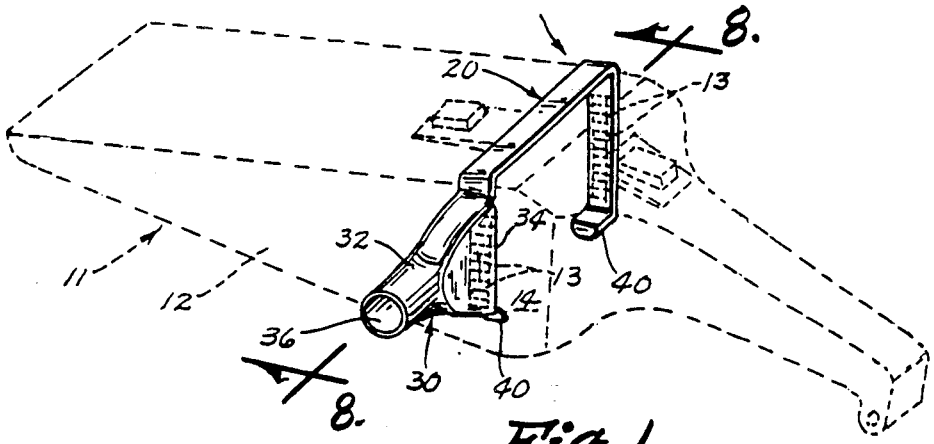
FIG. 1 is a perspective view of the blower attachment of the present invention attached to a hand-held, portable vacuum cleaner shown in dashed line.
Figure 2:
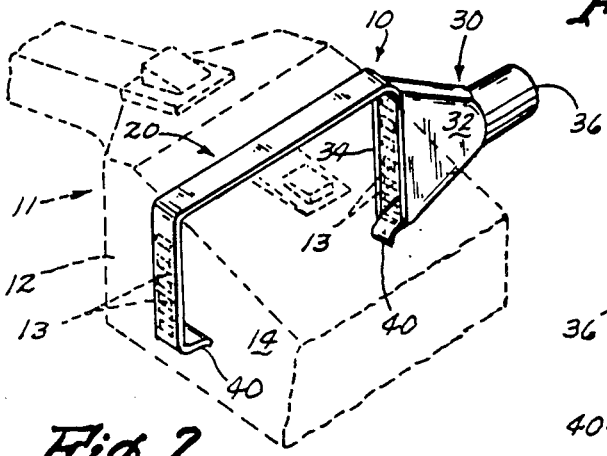
FIG. 2 is a perspective view taken from the side opposite that illustrated in FIG. 1.

Referring now to the drawings, wherein like reference numerals designate identical o corresponding parts throughout the several views, FIG. 1 shows the blower attachment (10) of the present invention secured to a handheld, battery-operated vacuum cleaner (11). The vacuum cleaner (11) includes a casing (12) having a number of peripherally aligned exhaust air discharge openings (13) spaced along opposite lateral sides (14). Although the vacuum cleaner (11) illustrated has a rectangular casing (12) and discharge openings (13) disposed only on the lateral sides (14), it is to be understood that the present invention could be adapted to casings of various contours with variously spaced exhaust air discharge openings. The blower attachment (10) comprises a generally U-shaped member that contacts a peripheral portion of the casing (12) over the discharge openings (13).

Figure 5:
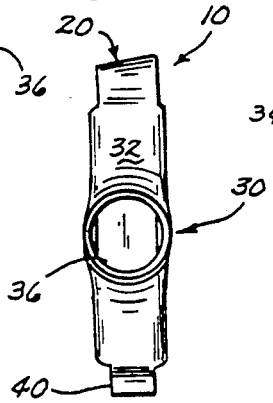
FIG. 5 is a side elevational view taken from the plenum section side.
Figure 6:
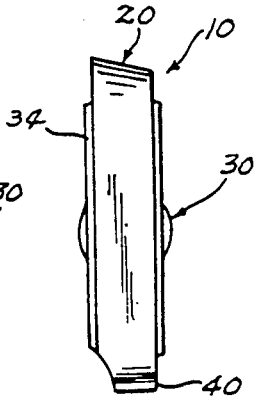
FIG. 6 is a side elevational view taken from the strap section side.
Figure 3:
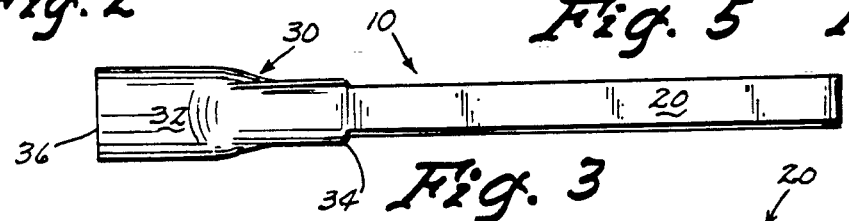
FIG. 3 is an enlarged top plan view of the blower attachment.
Figure 4:
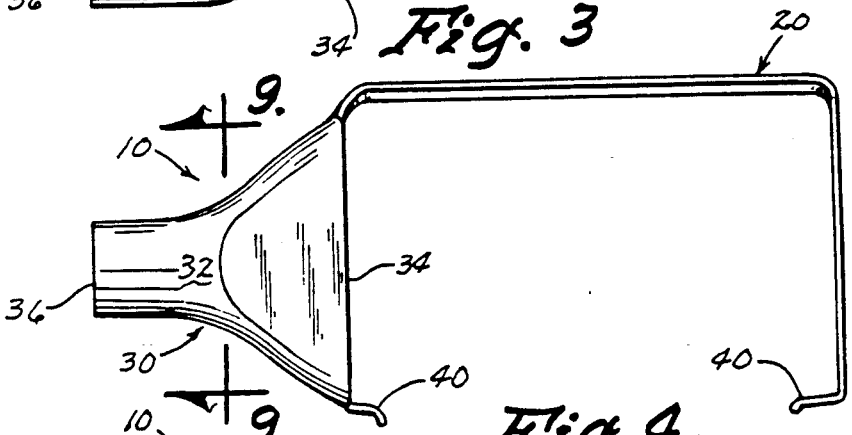
FIG. 4 is a front elevational view thereof.
Figure 7:
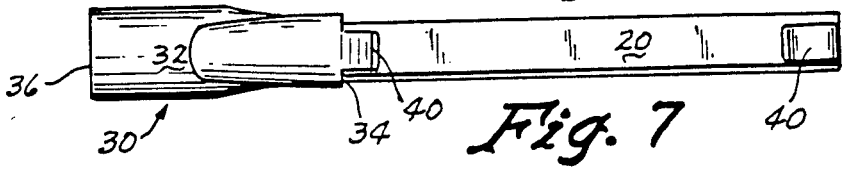
FIG. 7 is a bottom plan view thereof.

Referring now to FIGS. 3–6, the attachment (10) includes a strap section (20), a plenum section (30), and tabs (40) that extend inwardly from opposite ends of the attached member (10). The plenum section (30) includes a tubular housing (32) having an inlet port (34) which tapers down to a smaller output orifice (36). The attachment (10) is formed of a rigid, yet resilient, material that conforms to the contour of the casing (12). FIGS. 5 and 6, for example, show that the top of the strap section (20) slants to conform to the slope of the casing (12).

Figure 10:
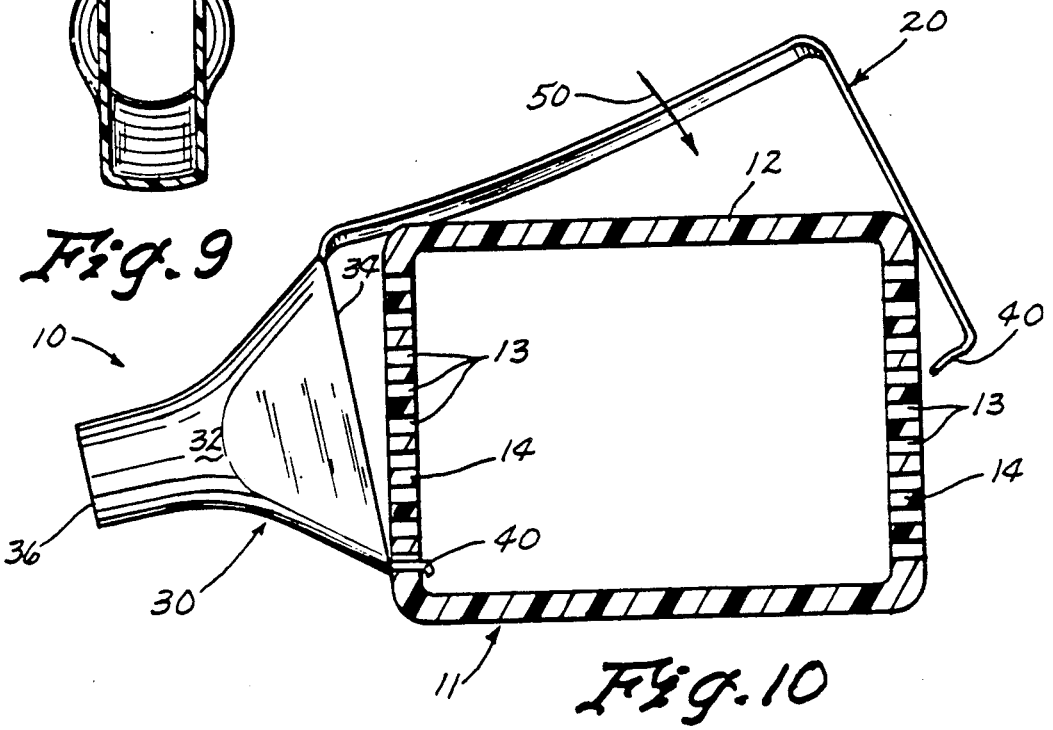
FIG. 10 is a sectional view similar to FIG. 8 and showing the method of attaching the attached member to the vacuum cleaner casing.

As best shown in FIG. 10, the attachment (10) is secured to the vacuum cleaner (11) by inserting one tab (40) extending from the plenum section (30) into the lowermost opening (13) on one lateral side (14). The strap section (20) is then moved down as indicated by the directional arrow (50) until the tab (40) extending from the end of the strap section (20) engages the lowermost opening (13) on the opposite lateral side (14).

Figure 8:
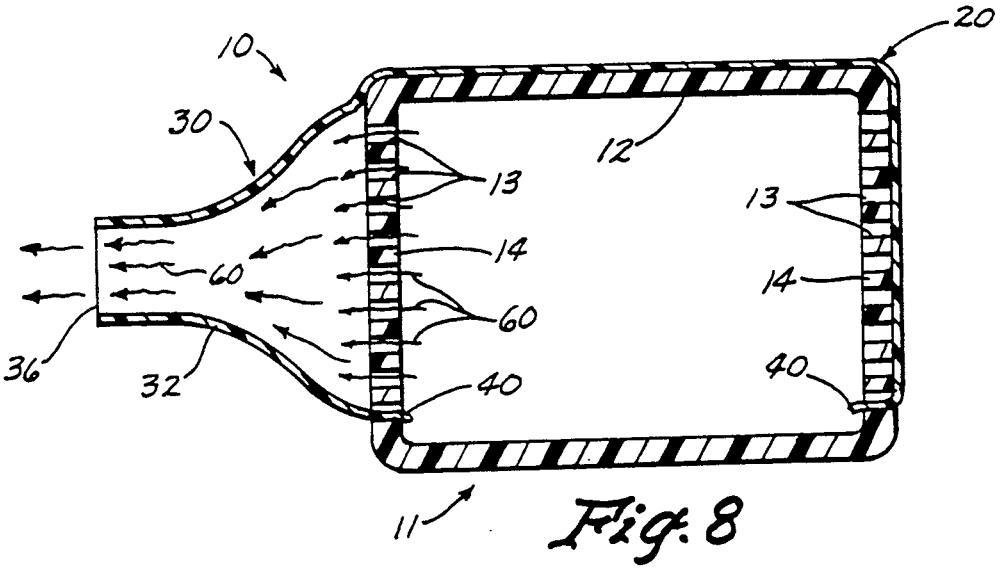
FIG. 8 is an enlarged sectional view taken along line 8—8 of FIG. 1 illustrating the air flow pattern from inside the vacuum cleaner casing, into the inlet port of the plenum section, and out the output orifice to the device to be inflated.
Figure 9:
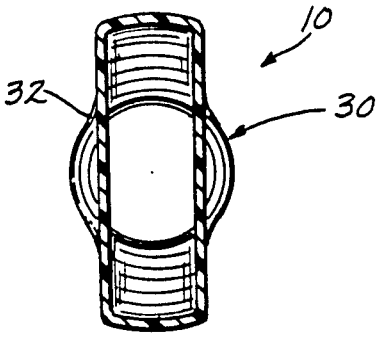
FIG. 9 is a sectional view taken along line 9—9 of FIG. 4.

Since the attachment (10) is made of resilient material, it is thus secured in an aligned position over the discharge openings as shown in FIG. 8.

In operation, exhaust air from the casing (12) flows through the discharge openings (13), into the plenum section (30), and out the output orifice (36). The strap section (20) blocks all discharge openings (13) that are not in communication with the plenum section (30). A high volume of low pressure air is therefore directed to the output orifice (36) as indicated by air flow arrows (60) for use in inflating any of a number of devices.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A blower attachment for a vacuum cleaner of the type including a casing having a single inlet and a plurality of peripherally aligned and opposed exhaust air discharge openings, said attachment comprising:

an attached member disposed to contact and overlie a peripheral portion of the casing over said discharge openings, said attached member including:

a generally L-shaped resilient strap section having one end disposed to extend over and block air flow from a number of the discharge openings; a plenum section operatively connected to the other end of the strap section and disposed to extend over the discharge openings remaining unblocked by the strap section, said plenum section including a tubular housing having an inlet port disposed over and in fluid communication with the unblocked discharge openings, and an air output orifice disposed to extend outwardly from the casing; and at least one tab extending from said attached member and disposed to be received in one of the discharge openings to secure the attached member to the casing over the discharge openings.

2. The attachment of claim 1 wherein at least two tabs extend from said attached member, each tab being disposed to be received in a separate peripherally spaced discharge openings.

3. The attachment of claim 2 wherein one of said tabs extends from each end of said attached member.

4. The attachment of claim 1 wherein said attached member is formed of resilient material shaped to conform to the peripheral contour of the casing.

5. The attachment of claim 4 wherein the casing-is rectangular and the discharge openings are disposed only at opposite lateral sides of the casing, and wherein the attached member is disposed such that the strap section extends over and blocks the discharge openings on one lateral side, and the plenum section extends over the discharge openings on the other lateral side.

6. The attachment of claim 1 wherein the inlet port is disposed over a plurality of discharge openings.

7. The attachment of claim 6 wherein the tubular housing tapers from the inlet port to a smaller output orifice.

* * * * *